US009122296B2

(12) United States Patent
Lam et al.

(10) Patent No.: US 9,122,296 B2
(45) Date of Patent: Sep. 1, 2015

(54) ADAPTIVE DC-LINK VOLTAGE CONTROLLED LC COUPLING HYBRID ACTIVE POWER FILTERS FOR REACTIVE POWER COMPENSATION

(75) Inventors: Chi-Seng Lam, Macau (CN); Man-Chung Wong, Macau (CN); Wai-Hei Choi, Macau (CN); Ying-Duo Han, Macau (CN)

(73) Assignee: UNIVERSITY OF MACAU, Macau (CN)

( * ) Notice: Subject to any disclaimer, the term of this patent is extended or adjusted under 35 U.S.C. 154(b) by 633 days.

(21) Appl. No.: 13/591,266

(22) Filed: Aug. 22, 2012

(65) Prior Publication Data

US 2014/0055104 A1 Feb. 27, 2014

(51) Int. Cl.
*G05F 1/70* (2006.01)

(52) U.S. Cl.
CPC ..... *G05F 1/70* (2013.01)

(58) Field of Classification Search
None
See application file for complete search history.

(56) References Cited

U.S. PATENT DOCUMENTS 5,751,138 A * 5/1998 Venkata et al. ..... 323/207
5,757,099 A * 5/1998 Cheng et al. ..... 307/105

FOREIGN PATENT DOCUMENTS

CN 201210051065.X 2/2012
CN 201210051133.2 7/2012

OTHER PUBLICATIONS

Chi-Seng Lam, Wai-Hei Choi, Man-Chung Wong, Ying-Duo Han, "Adaptive DC-link Voltage Controlled Hybrid Active Power Filters for Reactive Power Compensation," IEEE Transactions on Power Electronics, Sep. 29, 2011, pp. 1758-1772, vol. 27, issue: 4, Institute of Electrical and Electronics Engineers (IEEE), USA.

* cited by examiner

*Primary Examiner* — Jared Fureman
*Assistant Examiner* — Aqeel Bukhari
(74) *Attorney, Agent, or Firm* — Bacon & Thomas, PLLC

(57) ABSTRACT

An adaptive dc-link voltage controlled LC coupling hybrid active power filter (LC-HAPF) for reactive power compensation includes: two dc capacitors to provide dc-link voltage; a three-phase voltage source inverter to convert dc-link voltage into compensating voltages; three coupling LC circuits to convert compensating voltages into currents; and an adaptive dc voltage controller with reactive power compensation control algorithm. The control algorithm includes: first, calculating required minimum dc-link voltage in each phase with respect to loading reactive power; three-phase required minimum dc-link voltage will be maximum one among their minimum values; compare it with predetermined voltage levels to determine final reference dc-link voltage. A dc-link voltage feedback P/PI controller outputs dc voltage reference compensating currents. An instantaneous power compensation controller outputs reactive reference compensating currents. The final reference compensating currents will be sum of them. A PWM circuit provides LC-HAPF adaptive dc-link voltage control and dynamic reactive power compensation.

5 Claims, 13 Drawing Sheets

ADAPTIVE DC-LINK VOLTAGE CONTROLLED LC COUPLING HYBRID ACTIVE POWER FILTERS FOR REACTIVE POWER COMPENSATION

TECHNICAL FIELD

The present invention relates to a current quality compensator, and more particularly to an adaptive dc-link voltage controlled LC coupling hybrid active power filter for dynamic reactive power compensation under inductive loads.

BACKGROUND ART

Since the first installation of passive power filters (PPFs) in the mid 1940's, PPFs have been widely used to suppress current harmonics and compensate reactive power in distribution power systems due to their low cost, simplicity and high efficiency characteristics. Unfortunately, they have many disadvantages such as low dynamic performance, resonance problems, and filtering characteristic that is easily affected by small variations of the system parameters. Since the concept "Active ac Power Filter" was first developed by L. Gyugyi in 1976, the research studies of the active power filters (APFs) for current quality compensation are getting more interest since then. APFs can overcome the disadvantages inherent in PPFs, but their initial and operational costs are relatively high because the dc-link operating voltage should be higher than the system voltage. This results in slowing down their large-scale application in distribution networks. Later on, different hybrid active power filter (HAPF) topologies composed of active and passive components in series and/or parallel have been proposed, aiming to improve the compensation characteristics of PPFs and reduce the voltage and/or current ratings (costs) of the APFs, thus leading to effectiveness in cost and performance.

The HAPF topologies consist of many passive components, such as transformers, capacitors, reactors, and resistors, thus increasing the size and cost of the whole system. A transformerless LC coupling HAPF (LC-HAPF) has been recently proposed and applied for current quality compensation and damping of harmonic propagation in distribution power systems, in which it has only a few passive components and the dc-link operating voltage can be much lower than the APF. Its low dc-link voltage characteristic is due to the system fundamental voltage dropped across the coupling capacitance but not the active part of the LC-HAPF. In addition, the coupling LC circuit is designed based on the fundamental reactive power consumption and the dominant harmonic current of the loading. And the active part is solely responsible for the current harmonics compensation. Therefore, this LC-HAPF can only inject a fixed amount of reactive power which is provided by the coupling LC and thus achieving a low dc-link voltage level requirement in this special situation. In practical, because the load-side reactive power consumption varies from time to time, the LC-HAPF cannot perform satisfactory dynamic reactive power compensation. The larger the reactive power compensation difference between the load-side and coupling LC, the larger the system current and loss, and it will lower the power network stability. In addition, if the loading is dominated by a centralized air-conditioning system, its reactive power consumption will be much higher than the harmonic power consumption. Therefore, it is important and necessary for the LC-HAPF to possess dynamic reactive power compensation capability under this loading situation.

Besides, the LC-HAPF and other HAPF topologies are all operating at a fixed dc-link voltage level. Since the switching loss is directly proportional to the dc-link voltage, the system will obtain a larger switching loss if a higher dc-link voltage is used, and vice versa. Therefore, if the dc-link voltage can be adaptively changed according to different loading reactive power situations, the system can obtain better performances and operational flexibility.

There is a need for the LC-HAPF providing dynamic reactive power compensation capability with reducing switching loss and switching noise purposes.

SUMMARY OF THE INVENTION

One objective of the present invention is to provide the LC-HAPF dynamic reactive power compensation capability, which overcomes the existing LC-HAPF limitation of fixed reactive power compensation.

Another objective of the present invention is to provide an adaptive dc-link voltage control algorithm for LC-HAPF reactive power compensation, so that the switching loss and switching noise can be reduced, and so too the operational cost.

According to an aspect of the present invention, the adaptive dc-link voltage controlled LC-HAPF for reactive power compensation includes: two dc capacitors to provide dc-link voltage; a three-phase voltage source inverter to convert the dc-link voltage into compensating voltages; three coupling LC circuits to convert the three-phase compensating voltages into compensating currents, and then to be injected to the connection points between the power source and the inductive load; and an adaptive dc-link voltage controller with reactive power compensation control algorithm. The control algorithm includes the following steps: first of all, calculating the phase instantaneous loading reactive power $-q_{Lx}/2$ (subscript 'x' denotes phase a,b,c) based on instantaneous load voltage $v_x$ and load current $i_{Lx}$; obtaining the phase loading reactive power $Q_{Lx_f}=-q_{Lx_f}/2$ after passing the phase instantaneous loading reactive power $-q_{Lx}/2$ through a low pass filter; calculating the required minimum dc-link voltage $V_{dc_min\ x}$ for compensating the phase loading reactive power $Q_{Lx_f}$ in each phase; selecting the three-phase required adaptive minimum dc-link voltage $V_{dc_min}$ that will be the maximum one among the calculated $V_{dc_min\ x}$ in each phase; comparing $v_{dc_min}$ with predetermined voltage levels ($V_{dc1}$, $V_{dc2}$, . . . $V_{dcmax}$, $V_{dc1}<V_{dc2}$ . . . . $<V_{dcmax}$) to determine the final reference dc-link voltage $V_{dc}$*, wherein when the $V_{dc_min}$ is less than the lowest dc voltage level $V_{dc1}$, $V_{dc}*=V_{dc1}$; if not, repeat the steps until $V_{dc_min}$ is found to be less than a dc-link voltage level; and if $V_{dc_min}$ is greater than the maximum voltage level $v_{dc\ max}$, the final reference dc-link voltage will be $V_{dc}*=V_{dc\ max}$. In this way, the dc-link voltage fluctuation problem under the adaptive dc voltage control method can be lessened.

According to another aspect of the present invention, the adaptive dc-link voltage controlled LC-HAPF for reactive power compensation further comprises an instantaneous power compensation controller for outputting three-phase reactive reference compensating currents $i_{cx_q}$.

According to another aspect of the present invention, the adaptive dc-link voltage controlled LC-HAPF for reactive power compensation further comprises a dc-link voltage feedback P/PI controller ($Q_{dc}=-k_q\cdot(V_{dc}*-V_{dc})$ and $P_{dc}=k_p\cdot(V_{dc}*-V_{dc})$) for outputting three-phase dc-link voltage reference compensating currents $i_{cx_dc}$.

According to another aspect of the present invention, the adaptive dc-link voltage controlled LC-HAPF for reactive power compensation further comprises three adders for summing up the three-phase reactive reference compensating currents $i_{cx_q}$ and three-phase dc-link voltage reference compensating currents $i_{cx_dc}$ to output final reference compensating currents $i_{cx}$*.

According to another aspect of the present invention, the adaptive dc-link voltage controlled LC-HAPF for reactive power compensation further comprises a PWM circuit for receiving the differences between the final reference compensating currents $i_{cx}$* and actual compensating currents $i_{cx}$; and to generate PWM trigger signals to drive switching elements of the voltage source inverter for LC-HAPF adaptive dc-link voltage control and dynamic reactive power compensation, in which the switching loss and switching noise can be reduced compared with the conventional fixed dc-link voltage LC-HAPF.

DETAILED DESCRIPTION OF THE INVENTION

A preferred embodiment of the present invention will be described hereinafter with reference to the accompany drawings.

Figure 1:
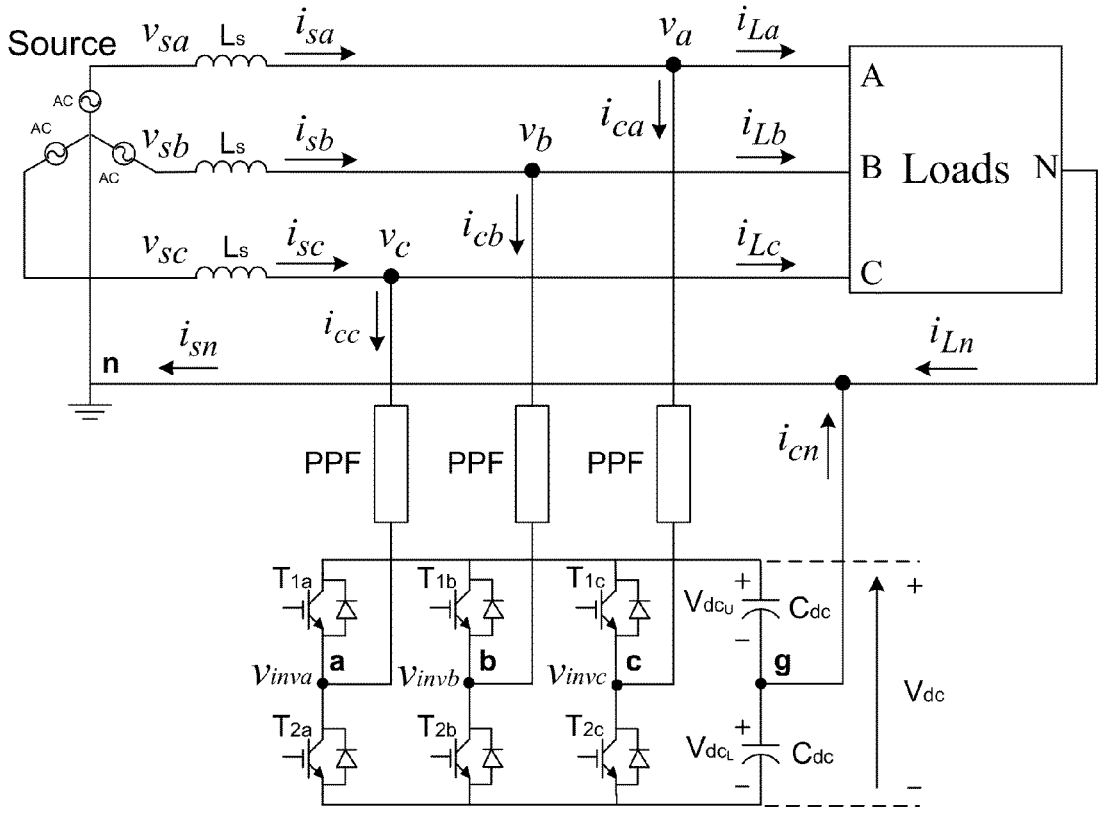
FIG. 1 shows a transformerless two-level three-phase four-wire center-split current quality compensator (CCQC).

Reference is now made to FIG. 1. A transformerless two-level three-phase four-wire center-split current quality compensator (CCQC) is shown in FIG. 1, where the subscript 'x' denotes phase a,b,c,n. v is the system voltage, $v_x$ is the load voltage. $L_s$ is the system inductance normally neglected due to its low value relatively, thus $v_{sx} \approx v_x$. $i_{sx}$, $i_{Lx}$ and $i_{cx}$ are the system, load and inverter current for each phase. PPF is the coupling passive power filter part, which can be composed of a resistor, inductor, capacitor or any combinations of them. $C_{dc}$, $V_{dc_U}$ and $V_{dc_L}$ are the dc capacitance, upper and lower dc capacitor voltages with $V_{dc_U}=V_{dc_L}=0.5V_{dc}$. The dc-link midpoint is assumed to be ground reference (g). From FIG. 1, the inverter line-to-ground voltages $v_{invx\text{-}g}$ will be equal to the inverter line-to-neutral voltages $v_{invx\text{-}n}$ because the neutral point n is connected to the dc-link midpoint g. Based on the pulsewidth modulation (PWM) technique, $v_{invx\text{-}n}$ can be simply treated as a controlled voltage source.

Figure 2:
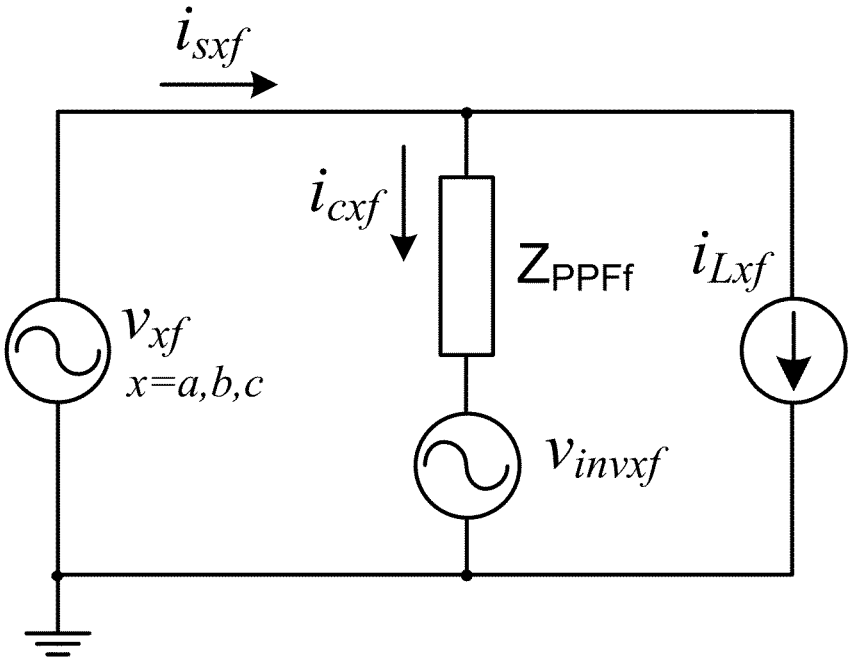
FIG. 2 shows a single-phase fundamental equivalent circuit model of the CCQC circuit configuration as shown in FIG. 1.

From the CCQC circuit configuration as shown in FIG. 1, its single-phase fundamental equivalent circuit model is shown in FIG. 2, where the subscript 'f' denotes the fundamental frequency component. In the following analysis, all the parameters are in root-mean-square (rms) values.

For simplicity, $v_{sx}$ and $v_x$ are assumed to be pure sinusoidal without harmonic components (i.e. $\vec{V}_x=\vec{V}_{xf}=|\vec{V}_x|=V_x$). From FIG. 2, the inverter fundamental voltage phasor $\vec{V}_{invx_f}$ can be expressed as:

$$\vec{V}_{invxf}=\vec{V}_x-\vec{Z}_{PPF_f}\cdot\vec{I}_{cxf} \tag{1}$$

Here, the fundamental compensating current phasor $\vec{I}_{cx_f}$ of the CCQC can be expressed as $\vec{I}_{cx_f}=I_{cx_{fp}}+jI_{cx_{fq}}$, where the subscripts 'p' and 'q' denote the active and reactive components. $I_{cx_{fp}}$ is the fundamental active current for compensating loss and dc-link voltage control while $I_{cx_{fq}}$ is the fundamental reactive current for compensating reactive power of the loading. Simplifying (1) yields, $$\vec{V}_{invxf}=V_{invx_{fp}}+jV_{invx_{fq}} \tag{2}$$

where $$\begin{aligned} V_{invx_{fp}} &= \vec{V}_x + I_{cx_{fq}} X_{PPF_f} \\ V_{invx_{fq}} &= -I_{cx_{fp}} X_{PPF_f} \end{aligned} \tag{3}$$

From (3), the fundamental compensating active current $I_{cx_{fp}}$ and reactive current $I_{cx_{fq}}$ are:

$$I_{cx_{fp}} = -\frac{V_{invx_{fq}}}{X_{PPF_f}} \tag{4}$$

$$I_{cx_{fq}} = \frac{V_{invx_{fq}} - V_x}{X_{PPF_f}} \tag{5}$$

Since the CCQC aims to compensate fundamental reactive power, the steady-state active fundamental current $I_{cx_{fp}}$ from the inverter is small ($I_{cx_{fp}} \approx 0$) provided that the dc-link voltage control is implemented. Thus, $V_{invx_{fq}} \approx 0$. Therefore, the effect of dc-link voltage control for the CCQC system can be simply neglected during steady-state situation.

For a fixed dc-link voltage level $V_{dc_U}=V_{dc_L}=0.5V_{dc}$ and modulation index m being assumed as $m \approx 1$, $R_{V_{dc}}$ represents the ratio between the dc-link voltage $V_{dc_U}$, $V_{dc_L}$ and load voltage $V_x$ reference to neutral n, which can be expressed as:

$$\begin{aligned} R_{V_{dc}} &= \frac{\pm V_{invxf}}{V_x} \\ &= \frac{\pm 0.5\ V_{dc}/\sqrt{2}}{V_x} \end{aligned} \tag{6}$$

-continued $$= \pm \frac{V_{dc}}{2\sqrt{2}\,V_x}$$

where $V_{invx_f}$ is the inverter fundamental rms voltage. If the PPF part is a pure inductor ($L_{c2}$), the CCQC will be the traditional APF. If the PPF part is composed of a series connection of an inductor ($L_{c1}$) and a capacitor ($C_{c1}$) the CCQC will be the LC-HAPF, in which $C_{c1}$ dominates the passive part at fundamental frequency. With the effect of dc-link voltage control being neglected ($I_{cx_{fp}}=0$) at steady-state, substituting $X_{PPF_f}=X_{Lc2_f}$ for APF and $X_{PPF_f}=-|X_{Cc1_f}-X_{Lc1_f}|$ for LC-HAPF, their corresponding fundamental reactive power injection range $Q_{cx_f}$ per square of the load voltage level $V_x^2$ with respect to different $R_{V_{dc}}$ can be shown in FIGS. 3*a* and 3*b*.

Figure 3A:
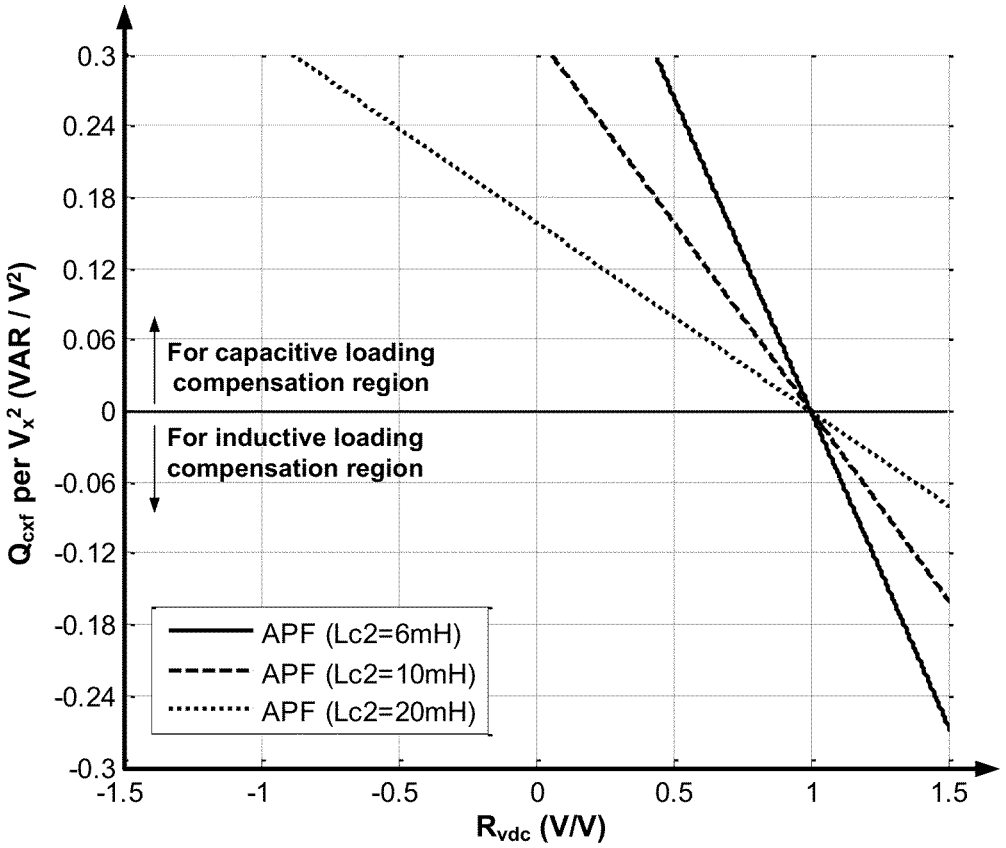
FIG. 3*a* shows fundamental reactive power injection range $Q_f$ per square of the load voltage $V_x^2$ with respect to different ratio $R_{V_{dc}}$ between the dc-link voltage and load voltage $V_x$ for APF.
Figure 3B:
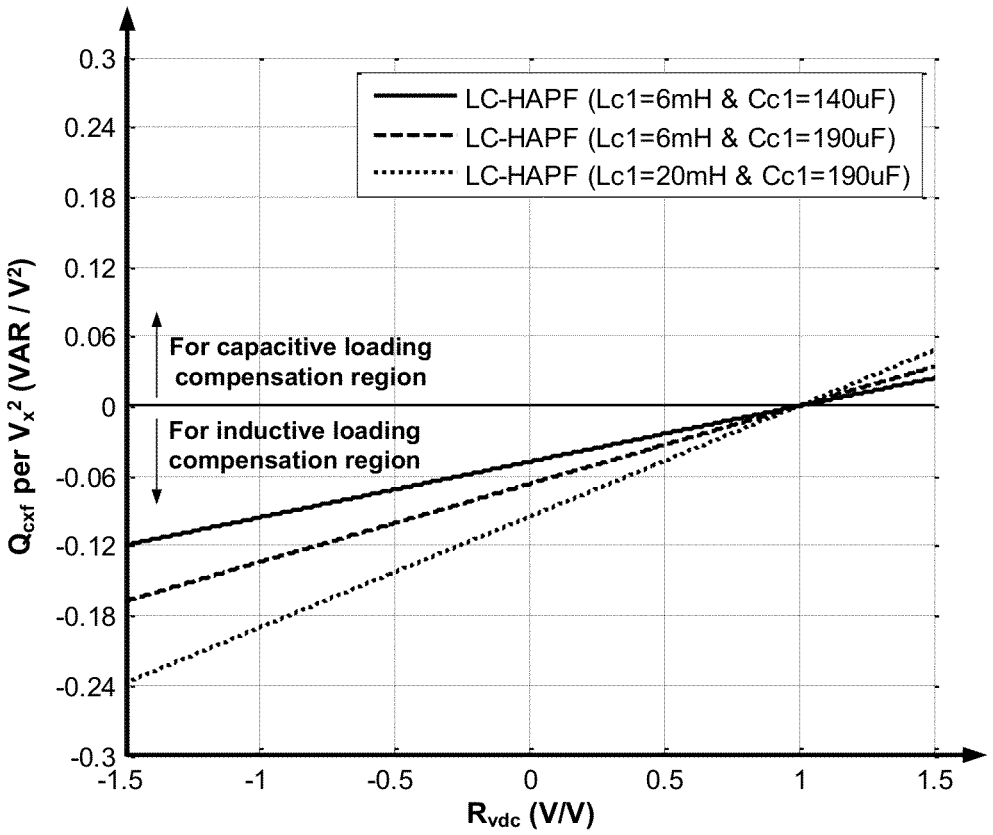
FIG. 3*b* shows fundamental reactive power injection range $Q_{cx_f}$ per square of the load voltage $V_x^2$ with respect to different ratio $R_{V_{dc}}$ between the dc-link voltage and load voltage $V_x$ for LC-HAPF.

Since $Q_{cx_f}$ should be negative for inductive loading compensation, from FIGS. 3*a* and 3*b*, the ratio $R_{V_{dc}}$ for APF must be at least greater than 1, while the ratio $R_{V_{dc}}$ for LC-HAPF is possible to be smaller than 1 within a specific operational range. This means that the required $V_{dc_U}$, $V_{dc_L}$ for APF must be larger than the peak of load voltage $V_x$ regardless of the coupling inductance $L_{c2}$, while the $V_{dc_U}$, $V_{dc_L}$ for LC-HAPF can be smaller than the peak of $V_x$ within that operational range. When $R_{V_{dc}}=0$, it means that both the APF and LC-HAPF are operating at pure passive filter mode, in which the APF at $R_{V_{dc}}=0$ cannot support inductive loading compensation while the LC-HAPF can support a fixed $Q_{cx_f}$. Moreover, this fixed $Q_{cx_f}$ depends on the passive part parameters. FIGS. 3*a* and 3*b* clearly illustrate the main advantage of LC-HAPF over the traditional APF under inductive loading reactive power compensation. Under the same dc-link voltage consideration in FIG. 3*b*, when the coupling capacitance $C_{c1}$ or inductance $L_{c1}$ increases, the upper limit of $|Q_{cx_f}|$ for inductive loading compensation region increases, however the lower limit of $|Q_{cx_f}|$ for that region decreases and vice versa. In the following description, the mathematical deduction details of the LC-HAPF fundamental reactive power compensation range with respect to the dc-link voltage under $I_{cx_{fp}}=0$ assumption will be given. After that, the required minimum dc-link voltage with respect to different inductive loading reactive power can be deduced.

Figure 4A:
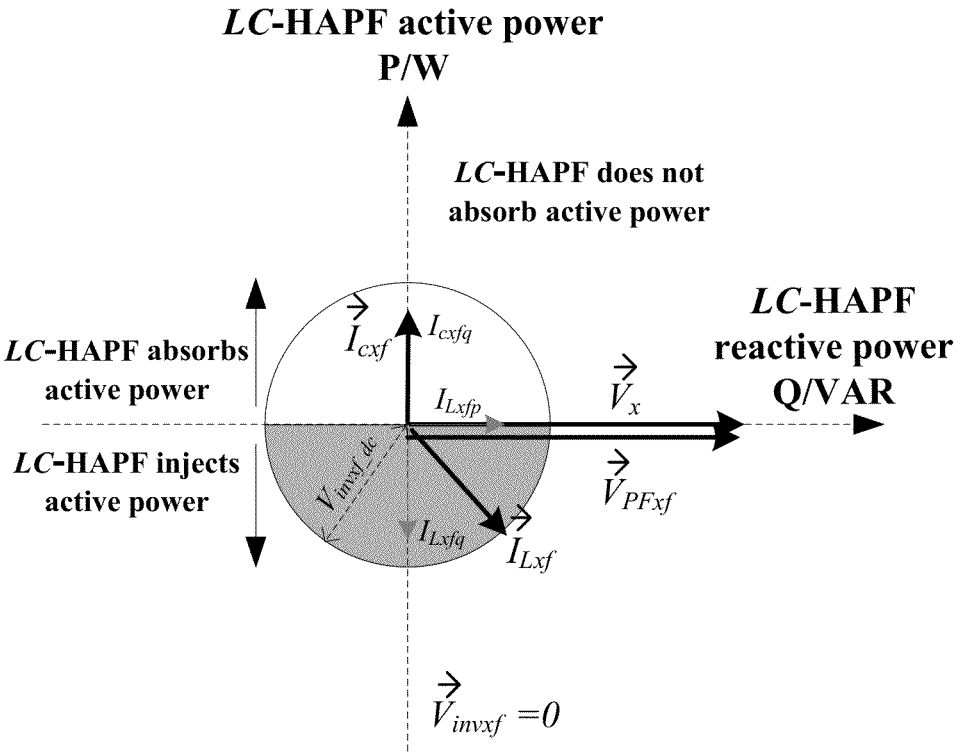
FIG. 4*a* shows LC-HAPF single-phase fundamental phasor diagram under inductive loading during full-compensation by coupling LC circuit.
Figure 4B:
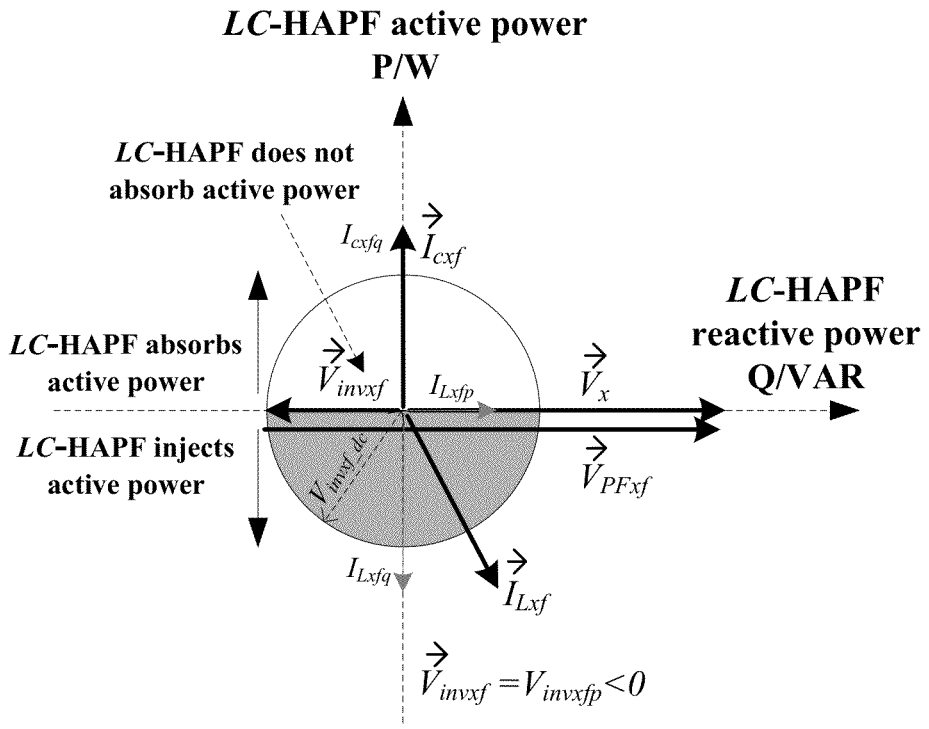
FIG. 4*b* shows LC-HAPF single-phase fundamental phasor diagram under inductive loading during under-compensation by coupling LC circuit.
Figure 4C:
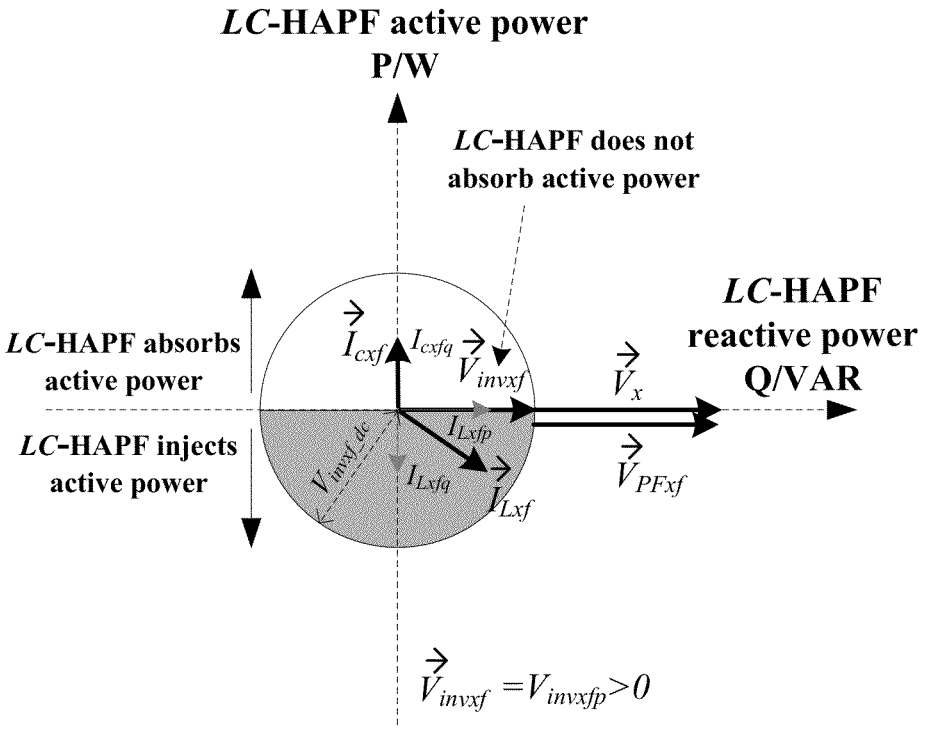
FIG. 4*c* shows LC-HAPF single-phase fundamental phasor diagram under inductive loading during over-compensation by coupling LC circuit.

Based on the previous assumption that the active fundamental current $I_{cx_{fp}}$ is very small ($I_{cx_{fp}}\approx 0$) at steady state, the inverter injects pure reactive fundamental current $\vec{I}_{cx_f}=jI_{cx_{fq}}$. Therefore, the $\vec{V}_{invx_f}$ in (2) contains pure active part as $V_{invx_{fp}}=V_x-I_{cx_{fq}}(X_{Cc1_f}-X_{Lc1_f})$ only. Then the LC-HAPF single-phase fundamental phasor diagram under inductive loading can be shown in FIGS. 4*a*, 4*b* and 4*c*. The vertical y-axis can be considered as the LC-HAPF active power (P/W) when locating $\vec{V}_x$ onto the LC-HAPF horizontal reactive power (Q/VAR) x-axis. The circle and its radius of $$V_{invx_{f_dc}} = \frac{0.5\ V_{dc}}{\sqrt{2}}$$

represent the LC-HAPF fundamental compensation range and maximum compensation limit under a fixed dc-link voltage. $\vec{V}_{PFx_f}$ is the fundamental voltage phasor of the coupling LC circuit. $\vec{I}_{Lx_f}$ is the fundamental load current phasor, where $I_{Lx_{fp}}$ and $I_{Lx_{fq}}$ are the fundamental load active and reactive current. In FIGS. 4*a*, 4*b* and 4*c*, the white semi-circle area represents LC-HAPF active power absorption region, whereas the shaded semi-circle area represents LC-HAPF active power injection region. When $\vec{V}_{invx_f}$ is located inside the white semi-circle area, the LC-HAPF is absorbing active power, on the other hand, the LC-HAPF is injecting active power when $\vec{V}_{invx_f}$ is located inside the shaded semi-circle area. When $\vec{V}_{invx_f}$ is located onto the Q/VAR x-axis, the LC-HAPF does not absorb active power. From FIGS. 4*a*, 4*b* and 4*c*, the LC-HAPF reactive power compensation range with respect to different dc-link voltage can be deduced.

When the loading reactive power $Q_{Lx_f}$ is full-compensation by coupling LC circuit $$(Q_{Lx_f} = |Q_{cx_{f_PF}}|)$$

as shown in FIG. 4*a*, the inverter does not need operation and output voltage ($V_{invx_{fp}}=0$). Thus, the switching loss and switching noise will be minimized in this situation. The LC-HAPF compensating reactive power $Q_{cx_f}$ is equal to the reactive power provided by the coupling LC circuit $$Q_{cx_{f_PF}},$$

which can be expressed as:

$$Q_{cx_f} = Q_{cx_{f_PF}} = -\frac{V_x^2}{|X_{Cc1_f} - X_{Lc1_f}|} < 0 \tag{7}$$

where $$Q_{cx_{f_PF}} < 0$$

means injecting reactive power or providing leading reactive power.

When the loading reactive power $Q_{Lx_f}$ is undercompensation by coupling LC circuit $$(Q_{Lx_f} > |Q_{cx_{f_PF}}|)$$

as shown in FIG. 4*b*, in order to generate a larger $I_{cx_{fq}}$, the inverter should output a negative inverter fundamental active voltage ($V_{invx_{fp}}<0$) as indicated by (5). With a fixed $V_{dc}$, the LC-HAPF maximum compensating reactive power limit $$Q_{cx_{f_max}}$$

can be deduced through the undercompensation by coupling LC circuit case, which can be expressed as:

$$Q_{cx_{f_max}} = -\frac{V_x^2(1+|R_{V_{dc}}|)}{|X_{Cc1_f} - X_{Lc1_f}|} \tag{8}$$

-continued $$= Q_{cx_{f_PF}}(1 + |R_{V_{dc}}|) < 0$$

When the loading reactive power $Q_{Lx_f}$ is overcompensation by coupling LC circuit $$(Q_{Lx_f} < |Q_{cx_{f_PF}}|)$$

as shown in FIG. 4*c*, in order to generate a smaller $I_{cx_{fq}}$, the inverter should output a positive inverter fundamental active voltage ($V_{invx_f}$>0) as indicated by (5). With a fixed $V_{dc}$, the LC-HAPF minimum compensating reactive power limit $$Q_{cx_{f_min}}$$

can be deduced through the overcompensation by coupling LC circuit case, which can be expressed as:

$$Q_{cx_{f_min}} = -\frac{V_x^2(1 + |R_{V_{dc}}|)}{|X_{Cc1_f} - X_{Lc1_f}|} = Q_{cx_{f_PF}}(1 + |R_{V_{dc}}|) < 0 \quad (9)$$

From (8) and (9), the larger the dc-link voltage $V_{dc}$ or ratio $R_{V_{dc}}$, the larger the LC-HAPF compensation range can be obtained, and vice versa. However, a larger dc-link voltage will increase the LC-HAPF switching loss and generate a larger switching noise into the system, while a smaller dc-link voltage will deteriorate the compensating performances if $Q_{Lx_f}$ is outside the LC-HAPF compensation range. When $V_{dc}$ is designed, the LC-HAPF reactive power compensating range for loading $Q_{Lx_f}$ can be expressed as:

$$|Q_{cx_{f_min}}| \le Q_{Lx_f} \le |Q_{cx_{f_max}}| \quad (10)$$

When $Q_{Lx_f}$ is perfectly compensated by the coupling LC circuit, the minimum dc-link voltage requirement ($V_{dc_U}$=$V_{dc_L}$=0) can be achieved. In addition, the larger the reactive power compensation differences between the loading and the coupling LC circuit, the larger the dc-link voltage requirement and vice versa. The required minimum dc-link voltage $V_{dc_min\ x}$ in each phase can be found by setting $$Q_{Lx_f} \approx |Q_{cx_{f_min}}| \approx |Q_{cx_{f_max}}|$$

in (10), $$V_{dc_minx} = 2\sqrt{2}\,V_x\left|1 - \frac{Q_{Lx_f}}{|Q_{cx_{f_PF}}|}\right| \quad (11)$$

Thus, (11) can be applied for the adaptive dc-link voltage control algorithm According to the present invention. Once the $Q_{Lx_f}$ is calculated, the corresponding $V_{dc_min\ x}$ in each phase can be obtained. Then the final three-phase required adaptive minimum dc-link voltage $V_{dc_min}$ can be chosen as follow:

$$V_{dc_min} = \max(V_{dc_min\ a}, V_{dc_min\ b}, V_{dc_min\ c}) \quad (12)$$

Figure 5:
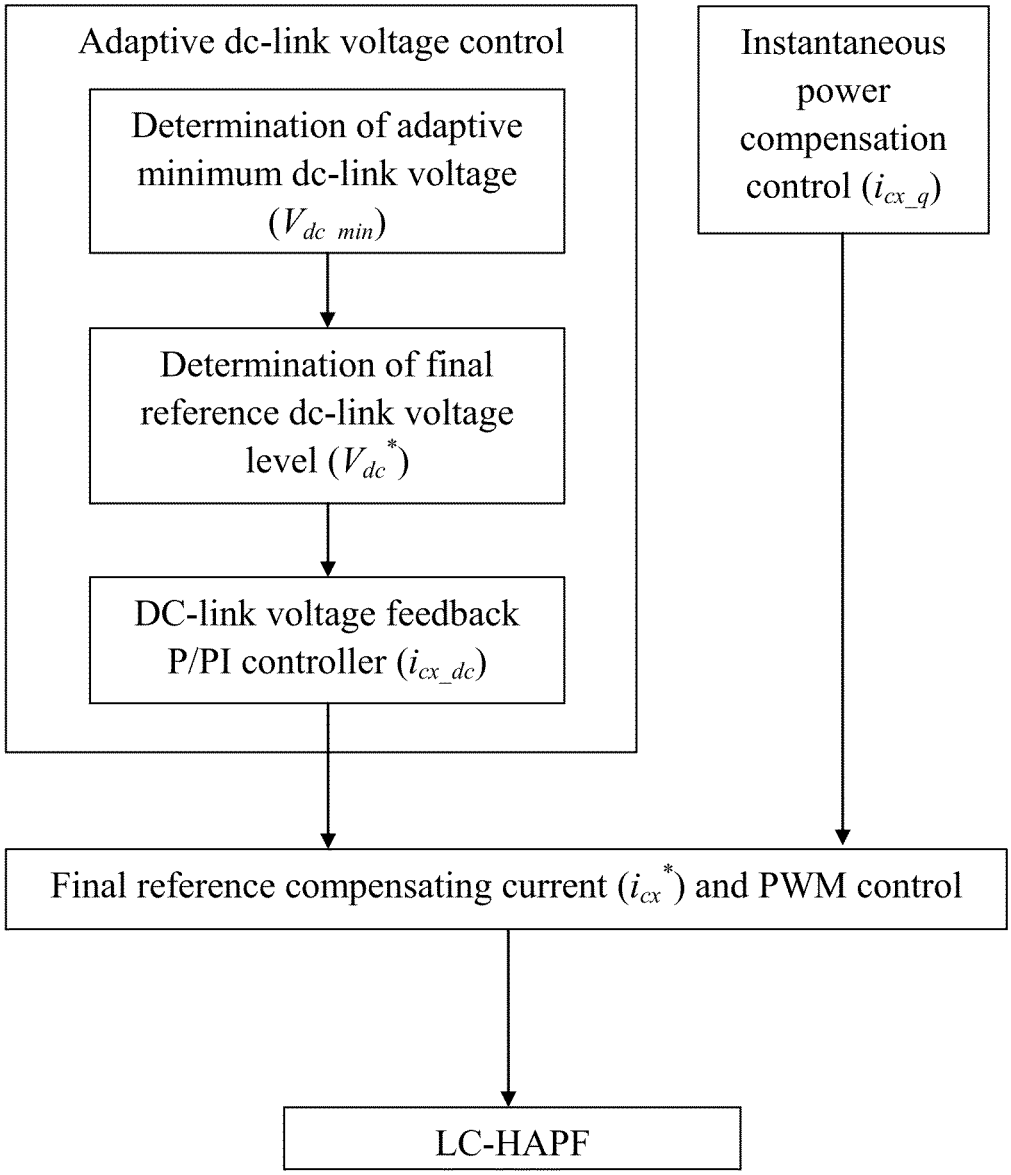
FIG. 5 shows adaptive dc-link voltage control block diagram for the three-phase four-wire LC-HAPF of FIG. 1 according to the present invention.

FIG. 5 shows the adaptive dc-link voltage control block diagram for the three-phase four-wire LC-HAPF of FIG. 1 according to an embodiment of the present invention, which consists of three main control blocks: instantaneous power compensation control block, adaptive dc-link voltage control block, and final reference compensating current and PWM control block. The adaptive dc-link voltage control block proposed by the present invention consists of three parts: (1) determination process of adaptive minimum dc-link voltage $V_{dc_min}$, (2) determination process of final reference dc-link voltage level $V_{dc}$*, and (3) a dc-link voltage feedback P/PI controller. Their details will be introduced in the following.

Figure 6:
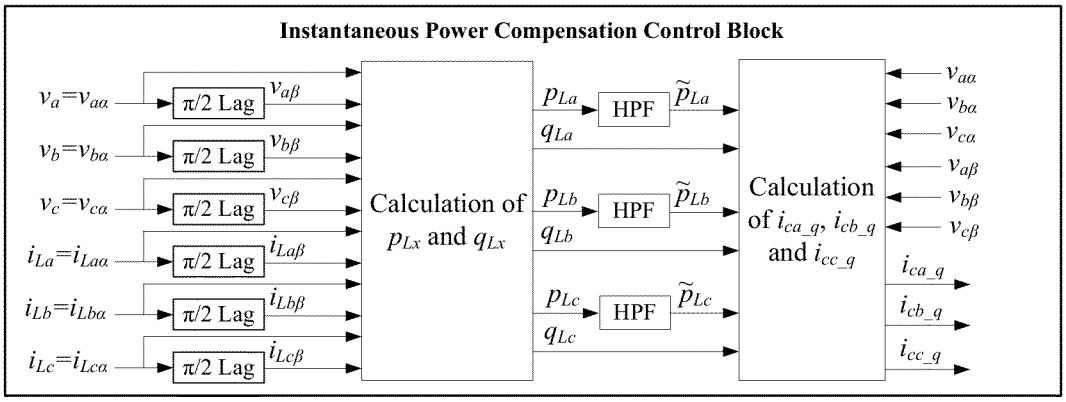
FIG. 6 shows an instantaneous power compensation control block.

FIG. 6 shows the instantaneous power compensation control block. For the instantaneous power compensation control block, the reference compensating currents for LC-HAPF ($i_{cx_q}$, the subscript x=a,b,c for three phases) are determined by the single-phase instantaneous pq theory (V. Khadkikar, A. Chandra, B. N. Singh, "Generalized single-phase p-q theory for active power filtering: simulation and DSP-based experimental investigation," *IET Power Electron*., vol. 2, pp. 67-78, January 2009).

Figure 7:
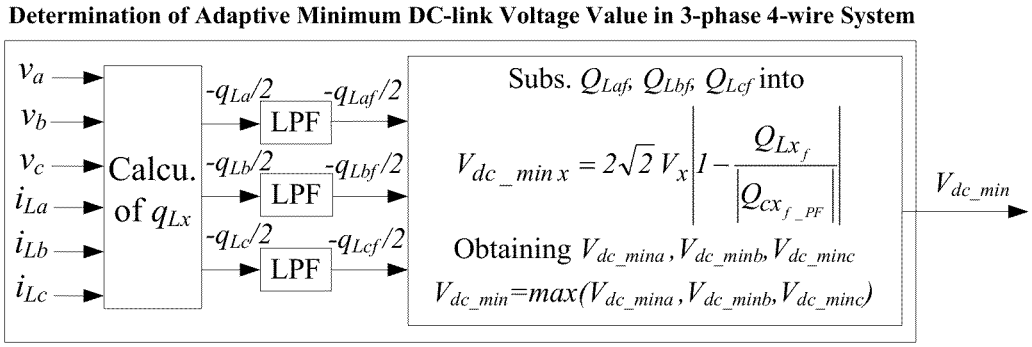
FIG. 7 shows the determination process of adaptive minimum dc-link voltage.

FIG. 7 shows the determination process of adaptive minimum dc-link voltage. Initially, the loading instantaneous fundamental reactive power $-q_{Lx_f}/2$ (x=a,b,c) in each phase are calculated using the single-phase instantaneous pq theory and low-pass filters. Usually, $-q_{Lx_f}/2$ can keep as a constant value for more than one cycle, thus $Q_{Lx_f}$ can be approximately treated as $Q_{Lx_f} \approx -q_{Lx_f}/2$. Then the required minimum dc-link voltage $V_{dc_min\ x}$ for compensating $Q_{Lx_f}$ in each phase can be calculated using (11), where $V_x$ is the rms load voltage and $$Q_{cx_{f_PF}}$$

can be obtained according to (7). The adaptive minimum dc-link voltage will be equal to $V_{dc_min}$, which can be determined by (12). During balanced loading case, the three-phase fundamental reactive power consumptions are the same ($Q_{La_f}$=$Q_{Lb_f}$=$Q_{Lc_f}$), therefore, $V_{dc_min}$=$V_{dc_min\ a}$=$V_{dc_min\ b}$=$V_{dc_min\ c}$. In order to implement the adaptive dc-link voltage control function for the three-phase four-wire LC-HAPF, $V_{dc_min}$ can be simply treated as the final reference dc-link voltage $V_{dc}$*. It is obvious that when the loading reactive power consumption ($Q_{Lx_f}$) is changing, the system will adaptively yield different $V_{dc_min\ x}$ and $V_{dc_min}$ values.

Figure 8:
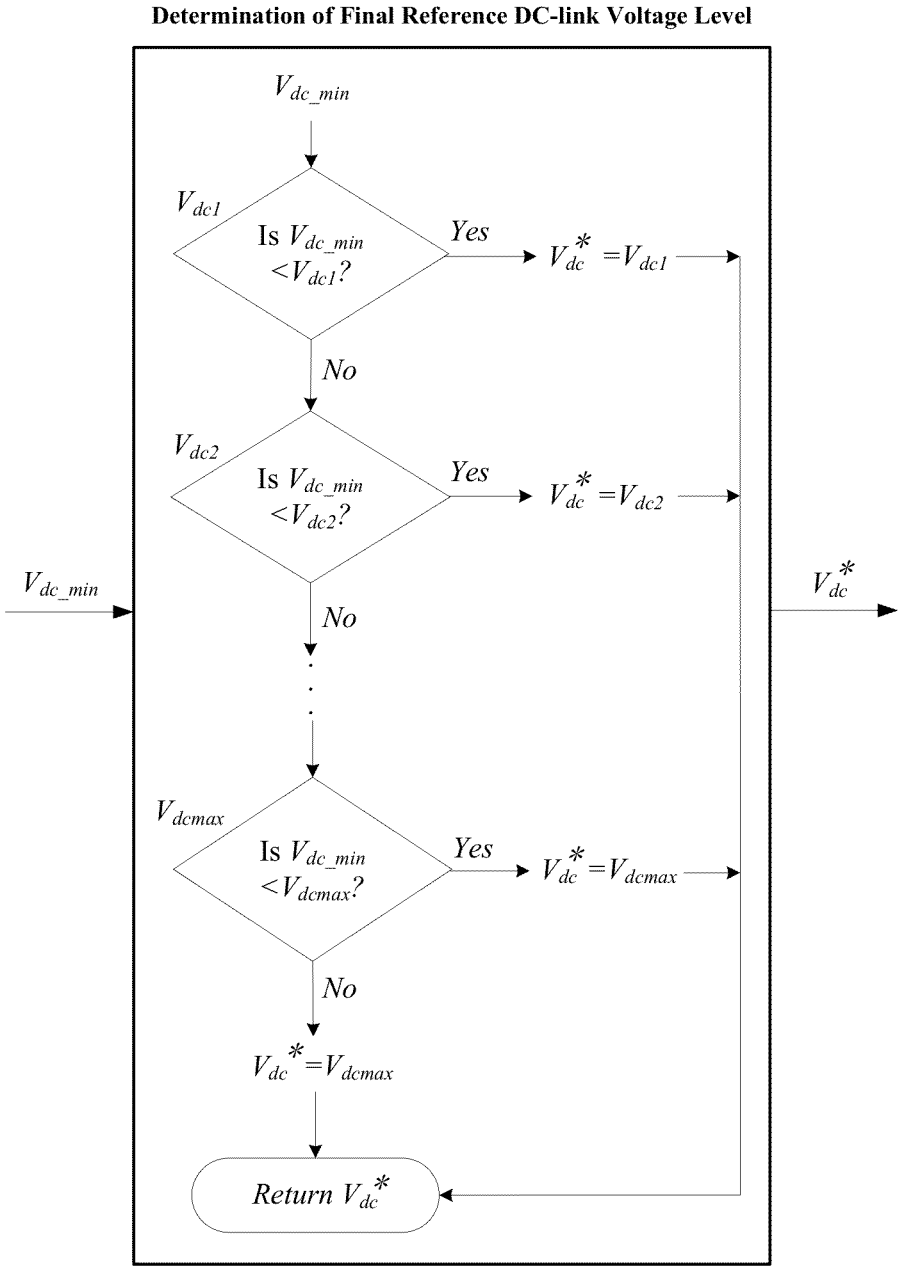
FIG. 8 shows the determination process of final reference dc-link voltage level.

FIG. 8 shows the determination process of final reference dc-link voltage level. This adaptive control scheme may frequently change the dc voltage reference $V_{dc}$* in practical situation, as the loading is randomly determined by electric users (different $Q_{Lx_f}$). Then this frequent change would cause a rapid dc voltage fluctuation, resulting in deteriorate the LC-HAPF operational performances (L. H. Wu, F. Zhuo, P. B. Zhang, H. Y. Li, Z. A. Wang, "Study on the influence of supply-voltage fluctuation on shunt active power filter," *IEEE Trans. Power Del*., vol. 22, pp. 1743-1749, July 2007). To alleviate this problem, a final reference dc-link voltage level determination process is added as shown in FIG. 8. The final reference dc-link voltage $V_{dc}$* is classified into certain levels ($V_{dc1}, V_{dc2}, \ldots V_{dc\ max}$, $V_{dc1}<V_{dc2}\ldots<V_{dc\ max}$) for selection, so that $V_{dc}$* can be maintained as a constant value within a specific compensation range. From FIG. 8, when the input $V_{dc_min}$ is less than the lowest dc voltage level $V_{dc1}$, the final reference dc-link voltage will be $V_{dc}^*=V_{dc1}$; if not, repeat the steps until $V_{dc_min}$ is found to be less than a dc-link voltage level. However, if $V_{dc_min}$ is greater than the maximum voltage level $V_{dc\ max}$, the final reference dc-link voltage will be $V_{dc}^*=V_{dc\ max}$. In this way, the dc-link voltage fluctuation problem under the adaptive dc voltage control method can be lessened.

Figure 9:
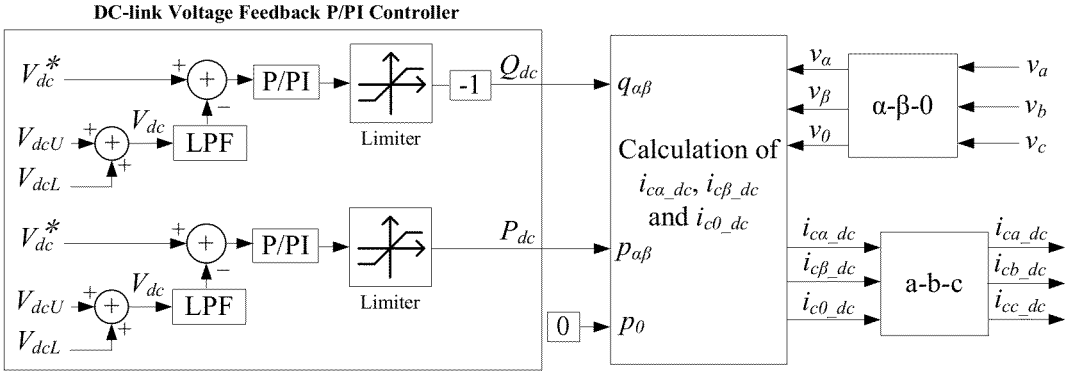
FIG. 9 shows a dc-link voltage feedback P/PI controller.

FIG. 9 shows the dc-link voltage feedback P/PI controller. The LC-HAPF can effectively control the dc-link voltage by feedback the dc-link voltage controlled signal as both reactive and active current components ($Q_{dc}$, $P_{dc}$).

$$Q_{dc}=-k_q\cdot(V_{dc}^*-V_{dc}) \tag{13}$$

$$P_{dc}=k_p\cdot(V_{dc}^*-V_{dc}) \tag{14}$$

where $Q_{dc}$ and $P_{dc}$ are the dc control signals related to the reactive and active current components, $k_q$ and $k_p$ are the corresponding positive gains of the controller. If the proportional gains $k_q$, $k_p$ in (13) and (14) are set too large, the stability of the control process will be degraded, and produces a large fluctuation during steady-state. On the contrary, if proportional gains are set too small, a long settling time and a large steady-state error will occur. To simplify the control process, $Q_{dc}$ and $P_{dc}$ in (13) and (14) are calculated by the same controller, i.e. $k_q=k_p$, and an appropriate value is selected. Actually, the adaptive control scheme can apply either P or PI controller for the dc-link voltage control. Even though the P controller can yield a steady-state error, it is chosen because it is simpler and has less operational machine cycles in the digital signal processor (DSP), therefore it can yield a faster response than the PI controller. If the dc-link voltage with zero steady-state error is taken consideration, PI controller is appreciated. A limiter is applied to avoid the overflow problem of the controller. With the help of the three-phase instantaneous pq theory (H. Akagi, S. Ogasawara, Kim Hyosung, "The theory of instantaneous power in three-phase four-wire systems: a comprehensive approach," in *Conf Rec. IEEE-34th IAS Annu. Meeting*, 1999, vol. 1, pp. 431-439), the dc-link voltage $V_{dc}$ can trend its reference $V_{dc}^*$ by changing the dc voltage reference compensating currents ($i_{cx_dc}$). Therefore, the proposed adaptive dc-link voltage control scheme for the LC-HAPF can then be implemented under various inductive linear loading conditions. In addition, the LC-HAPF initial start-up self-charging function can also be carried out by the adaptive dc-link voltage control scheme proposed by the present invention.

Figure 10:
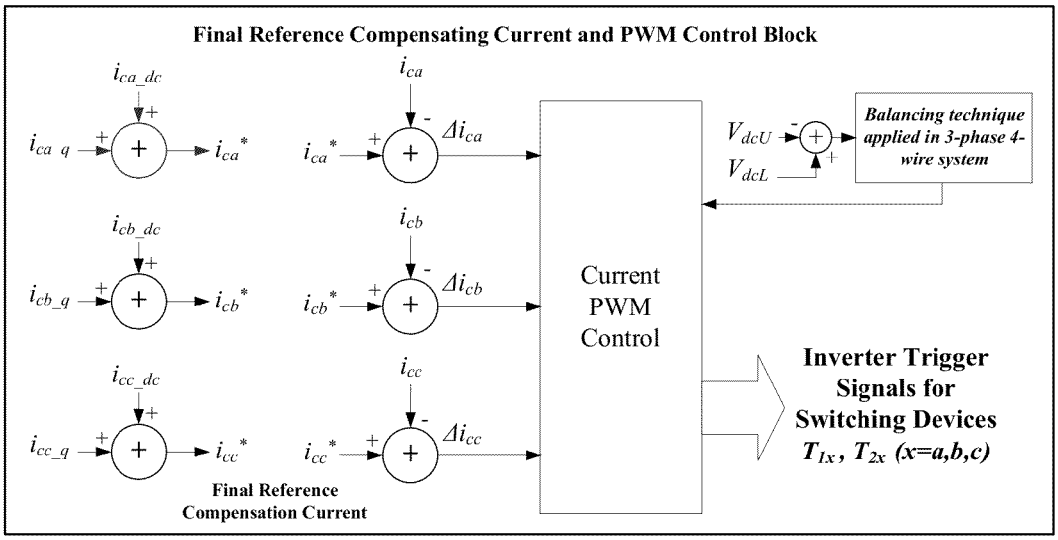
FIG. 10 shows a final reference compensating current and PWM control block.

FIG. 10 shows the final reference compensating current and PWM control block. The current control PWM method is applied for the LC-HAPF. After the process of instantaneous power compensation and the adaptive dc-link voltage control blocks proposed by the present invention as in FIG. 5, the final reference compensating currents $i_{cx}^*$ can be obtained by summing up the $i_{cx_q}$ and $i_{cx_dc}$. Then the final reference and actual compensating currents $i_{cx}^*$ and $i_{cx}$ will be sent to the PWM control part, and the PWM trigger signals for the switching devices can then be generated. If the three-phase loadings are unbalanced in three-phase four-wire power system, the dc capacitor voltage imbalance may occur, the dc capacitor voltage balancing technique (M. Aredes, J. Hafner and K. Heumann, "Three-phase four-wire shunt active filter control strategies," *IEEE Trans. Power Electron.*, vol. 12, pp. 311 318, March 1997) can be applied to balance the $V_{dc_U}$ and $V_{dc_L}$ under the proposed adaptive dc voltage control method. The adaptive dc-link voltage controlled LC-HAPF proposed by the present invention can compensate the dynamic reactive power, and reduce the switching loss and switching noise.

CONCLUSION

An adaptive dc-link voltage controlled LC coupling hybrid active power filter (LC-HAPF) with dynamic reactive power compensation capability is described above. In order to implement the adaptive dc-link voltage control algorithm, the LC-HAPF required minimum dc-link voltage for compensating different reactive power is deduced and its adaptive control block diagram is also built. The final reference dc-link voltage is classified into certain levels for selection, so that the impact on the compensation performances by the fluctuation of the adaptive dc-link voltage in practical case can be reduced. The adaptive dc-link voltage controlled LC-HAPF provided by the present invention can achieve a good dynamic reactive power compensation performance as well as reducing the switching loss and switching noise compared with the traditional fixed dc-link voltage LC-HAPF. Therefore, the adaptive dc-link voltage controlled LC-HAPF proposed by the present invention is a cost-effective solution for dynamic reactive power compensation in practical situation. Nevertheless, this adaptive control method would not reduce the initial cost of the LC-HAPF because its maximum compensation range is merely determined by its specifications.

The present invention is not limited to the above description. One skilled in the art may make various modifications to the details of the embodiment without departing from the scope and the spirit of the present invention.

What is claimed is:

1. An adaptive dc-link voltage controlled LC coupling hybrid active power filter (LC-HAPF) for reactive power compensation connected in parallel with an inductive load powered by a power source, comprising:

two dc capacitors to provide dc-link voltage;

a three-phase voltage source inverter to convert the dc-link voltage into compensating voltages;

three coupling LC circuits to convert the three-phase compensating voltages into compensating currents, and then to be injected to the connection points between the power source and the load; and an adaptive dc voltage controller with reactive power compensation control algorithm comprising:

calculating the phase instantaneous loading reactive power $-q_{Lx}/2$ (subscript 'x' denotes phase a,b,c) based on instantaneous load voltage $v_x$ and load current $i_{Lx}$;

obtaining the phase loading reactive power $Q_{Lx_f}=-q_{Lx_f}/2$ after passing the phase instantaneous loading reactive power $-q_{Lx}/2$ through a low pass filter;

calculating the required minimum dc-link voltage $V_{dc_min\ x}$ for compensating the phase loading reactive power $Q_{Lx_f}$ in each phase based on the calculated phase loading reactive power $Q_{Lx_f}$, reactive power $$Q_{cx_{f_PF}}$$

provided by the coupling LC circuit and the instantaneous load voltage $V_x$ using the following equation;

$$V_{dc_minx} = 2\sqrt{2}\,V_x\left|1 - \frac{Q_{Lx_f}}{|Q_{cx_{f_PF}}|}\right|$$

selecting the three-phase required adaptive minimum dc-link voltage $V_{dc_min}$ that will be the maximum one among the calculated $V_{dc_min\,x}$ in each phase, as given below $$V_{dc_min}=\max(V_{dc_min\,a}, V_{dc_min\,b}, V_{dc_min\,c})$$

and comparing $V_{dc_min}$ with predetermined voltage levels ($V_{dc1}$, $V_{dc2}$, . . . $V_{dcmax}$, $V_{dc1}<V_{dc2}$ . . . $<V_{dcmax}$) to determine a final reference dc-link voltage $V_{dc}$*, wherein when the $V_{dc_min}$ is less than the lowest dc voltage level $V_{dc1}$, $V_{dc}$*=$V_{dc1}$; if not, repeat the steps until $V_{dc_min}$ is found to be less than a dc-link voltage level; and if $V_{dc_min}$ is greater than the maximum voltage level $V_{dc\,max}$, the final reference dc-link voltage will be $V_{dc}$*=$V_{dc\,max}$.

2. The adaptive dc-link voltage controlled LC coupling hybrid active power filter for reactive power compensation according to claim 1, further comprising:

an instantaneous power compensation controller for outputting three-phase reactive reference compensating currents $i_{cx_q}$.

3. The adaptive dc-link voltage controlled LC coupling hybrid active power filter for reactive power compensation according to claim 2, further comprising:

a dc-link voltage feedback P/PI controller for outputting three-phase dc-link voltage reference compensating currents $i_{cx_dc}$.

4. The adaptive dc-link voltage controlled LC coupling hybrid active power filter for reactive power compensation according to claim 3, further comprising:

three adders for summing up the three-phase reactive reference compensating currents $i_{cx_q}$ and the three-phase dc-link voltage reference compensating currents $i_{cx_dc}$ to output final reference compensating currents $i_{cx}$.

5. The adaptive dc-link voltage controlled LC coupling hybrid active power filter for reactive power compensation according to claim 4, further comprising:

a PWM circuit for receiving the differences between the final reference compensating currents $i_{cx}$* and actual compensating currents $i_{cx}$ to generate PWM trigger signals to drive switching elements of the three-phase voltage source inverter for the LC-HAPF adaptive dc-link voltage control and dynamic reactive power compensation.

* * * * *